US006371192B1

(12) United States Patent
Anderson et al.

(10) Patent No.: US 6,371,192 B1
(45) Date of Patent: Apr. 16, 2002

(54) HEADRAIL, INCLUDING A TRAP DOOR FOR ACCESSING BATTERIES FOR POWERED COVERINGS FOR ARCHITECTUAL OPENINGS

(75) Inventors: Richard N. Anderson, Whitesville, KY (US); Donald E. Fraser, St. Petersburg, FL (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/480,913

(22) Filed: Jan. 11, 2000

Related U.S. Application Data

(60) Provisional application No. 60/115,393, filed on Jan. 11, 1999, provisional application No. 60/126,104, filed on Mar. 25, 1999, and provisional application No. 60/138,743, filed on Jun. 11, 1999.

(51) Int. Cl.[7] ..... E06B 9/38

(52) U.S. Cl. ..... 160/178.1 R; 160/168.1 P; 160/176.1 P; 429/99; 429/100

(58) Field of Search ..... 160/168.1 P, 176.1 P, 160/84.02, 310, 188, 178.1 R, 178.1 V; 429/99, 100

(56) References Cited

U.S. PATENT DOCUMENTS

| | | | | |
|---|---|---|---|---|
| 3,941,618 | A | * | 3/1976 | Mabuchi |
| 4,206,274 | A | * | 6/1980 | Peels |
| 4,269,908 | A | * | 5/1981 | Stemme |
| 4,391,883 | A | * | 7/1983 | Williamson et al. |
| 4,623,012 | A | | 11/1986 | Rude et al. |
| 4,885,219 | A | * | 12/1989 | Miller |
| 5,228,491 | A | | 7/1993 | Rude et al. |
| 5,444,339 | A | * | 8/1995 | Domel et al. |
| 5,495,153 | A | | 2/1996 | Domel et al. |
| 5,517,094 | A | * | 5/1996 | Domel et al. |
| 5,662,154 | A | | 9/1997 | Drake, III |
| 6,062,290 | A | * | 5/2000 | Domel |

FOREIGN PATENT DOCUMENTS

| | | |
|---|---|---|
| AU | 76262/91 | 11/1991 |
| CA | 2162443 | 5/1996 |
| DE | 8223913 | 5/1983 |
| DE | 29508479 | 9/1995 |
| GB | 2076454 | 9/1983 |
| NZ | 161962 | 11/1970 |

* cited by examiner

*Primary Examiner*—Blair M. Johnson
(74) *Attorney, Agent, or Firm*—Dorsey & Whitney LLP

(57) ABSTRACT

A headrail including a battery holder mounted within an interior of the headrail and a trap door for access to the batteries being held by the battery holder is disclosed. The headrail comprises a housing defining an interior into which a battery holder is mounted. In this manner, the batteries are hidden within the headrail for a more aesthetically pleasing look than can be achieved when the batteries are mounted outside of the headrail. The housing includes a large opening in its bottom wall to which the batteries may be accessed, and a trap door that selectively covers or uncovers the large opening. The trap door is swingably mounted on a battery bracket, and the trap door and battery bracket cooperate to facilitate easy removal and replacement of batteries into the headrail housing.

36 Claims, 10 Drawing Sheets

HEADRAIL, INCLUDING A TRAP DOOR FOR ACCESSING BATTERIES FOR POWERED COVERINGS FOR ARCHITECTUAL OPENINGS

CROSS-REFERENCE TO RELATED APPLICATIONS

This application is related and claims priority to United States provisional application Serial Nos. 60/115,393, filed Jan. 11, 1999, and entitled "Window Blind with Motorized Tilt Control"; and 60/126,104, filed Mar. 25, 1999, and entitled "Motorized Blind." It is also related and claims priority to United States provisional application Serial No. 60/138,743, filed Jun. 11, 1999, and entitled "Headrail Including a Detachable Battery Holder for Powered Coverings for Architectural Openings." The present application is also related to United States utility application Ser. Nos. 09/481,237, filed Jan. 11, 2000, entitled "Headrail Including a Detachable Battery Holder for Powered Coverings for Architectural Openings"; 09/480,912, filed Jan. 11, 2000, entitled "System for Holding Batteries in a Headrail for Powered Coverings for Architectural Openings"; 09/481,746, filed Jan. 11, 2000, entitled "Fiber Optic Cable, Signal-Receiving System"; and 09/481,307, filed Jan. 11, 2000, entitled "Headrail and Control System for Powered Coverings for Architectural Openings," all of which are being filed concurrently herewith. Each of these related applications (namely, the '393, '104, '743, '237, '912, '746, and '307 applications) is hereby incorporated by reference as though fully set forth herein.

BACKGROUND OF THE INVENTION a. Field of the Invention

The instant invention is directed toward a headrail for powered coverings for architectural openings. More specifically, it relates to a headrail including a trap door for accessing batteries for a battery-powered adjustable covering for an architectural opening.

b. Background Art

It is well known to use adjustable coverings over architectural openings. Such adjustable coverings include cellular panels, Venetian blinds, and many other mechanisms for controlling the passage of light, vision, or air through the architectural openings. For example, cellular panels and Venetian blinds may be adjusted by retracting or extending them, and Venetian blinds may be adjusted by tilting the slats. Depending upon the specific type of mechanism, other adjustments are possible.

It is also known in the art to power these adjustable coverings. For example, electric motors may be used in connection with the adjustable coverings to facilitate retracting the coverings or otherwise adjusting the coverings to control the amount of light, vision, or air that may pass through the coverings. It is also known in the art to use battery-powered electric motors, particularly in applications where access to an electrical outlet or other electrical wiring may not exist. In applications where access to the covering may be limited, it is also know to use remote controls to operate the electric motors that allow a user to selectively configure the covering. For example, when adjustable coverings are used in connection with elevated architectural openings, it may be quite inconvenient to manually change the configuration of the coverings.

When an adjustable covering is battery powered, it is challenging to design an aesthetically pleasing system wherein the battery or batteries are convenient to the electric actuators they power. To design an attractive battery-powered adjustable covering, it is preferable that the battery or batteries are located within the headrail and thereby hidden from view. Placing the battery or batteries within the headrail, however, can make it difficult to change the batteries as they become depleted.

SUMMARY OF THE INVENTION

The headrail of the present invention has been designed such that a battery or batteries for a powered covering for an architectural opening are conveniently hidden within the headrail and accessible for removal and replacement. The headrail preferably comprises a housing having an interior and a bottom wall with an opening in it. A battery magazine is attached within the interior of the housing such that at least a portion of the battery magazine is positioned above the opening in the bottom wall. A trap door is swingably associated with the bottom wall of the housing to selectably cover the opening for convenient access to the batteries in the battery magazine.

In a form of the invention, the trap door is swingably attached to the magazine by a battery bracket that includes at least one door mount. The at least one door mount engages a bracket-retention channel comprising part of the trap door.

In another form of the invention, the battery bracket further includes at least one rail slidably connected to the battery magazine or the housing. In a preferred form, the battery bracket has two rails that are joined on one of their ends by a crossover section and are slidably engaged in corresponding rail guide channels formed in the battery magazine. The other ends of the rails jog inwardly, forming a pair of door mounts. These door mounts engage the bracket-retention channel comprising part of the trap door.

In yet another form, the trap door itself further comprises a first longitudinal end and a second longitudinal end. The bracket-retention channel is adjacent the first longitudinal end. At least one protrusion extends from the second longitudinal end of the trap door. This protrusion interacts with the bottom wall of the housing to hold the trap door closed after it has been pivoted against the bottom wall of the housing to selectively cover the opening. The protrusion may include a sloped surface that helps it snap into the opening in the bottom wall of the housing. It is also beneficial for the trap door to include a handle adjacent the protrusion. The trap door may also include a protruding strip along each of its longitudinal edges, extending between its first and second longitudinal ends, wherein the protruding strips rest against an exterior of the bottom wall of the housing when the trap door is closed.

Other aspects, features, and details of the present invention will be apparent from reading the following description and claims, and from reviewing the accompanying drawings.

DESCRIPTION OF THE PREFERRED EMBODIMENT

A preferred embodiment of a headrail for a battery-powered adjustable covering for an architectural opening is disclosed. An advantage of the instant invention over the prior art is that batteries are hidden within the headrail and thereby hidden from view yet easily accessible without completely disassembling the headrail. A trap door is provided in the bottom of the housing that works in combination with a battery bracket to permit easy removal and installation of batteries from and into the headrail.

Figure 1:
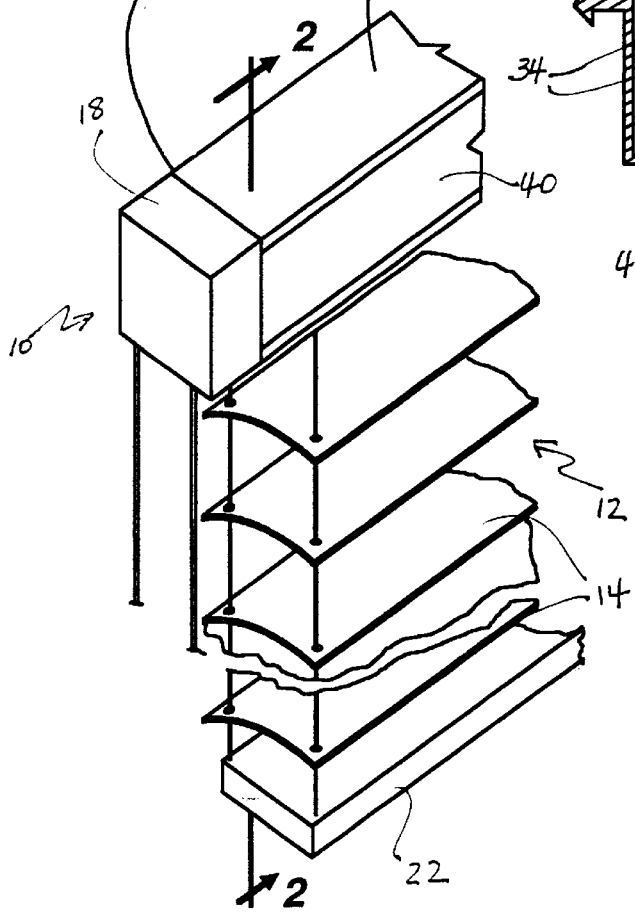
FIG. 1 is a fragmentary isometric view showing the front, top, and left end of a headrail, adjustable covering, and bottom rail for an architectural opening.

Referring first to FIG. 1, a fragmentary isometric view of the front, top, and left end of a headrail 10 and an adjustable covering 12 for an architectural opening is shown. Although the adjustable covering 12 depicted in FIG. 1 is a Venetian blind comprising a plurality of slats 14, for purposes of the instant invention, the particular type of covering is unimportant. FIG. 1, therefore, provides a context for describing the present invention. In the Venetian blind covering 12 of FIG. 1, a battery-powered motor (not shown) within a housing 16 of the headrail 10 may be used, for example, to regulate the passage of air or light through the substantially horizontal slats 14 of the covering 12 by selectively tilting or rotating the slats 14 about their longitudinal axes. As depicted in FIG. 1, the headrail 10 has a left end cap 18 attached to a left end 20 of the housing 16. Also as shown in FIG. 1, a bottom rail 22 is attached at the bottom of the covering 12.

Figure 2:
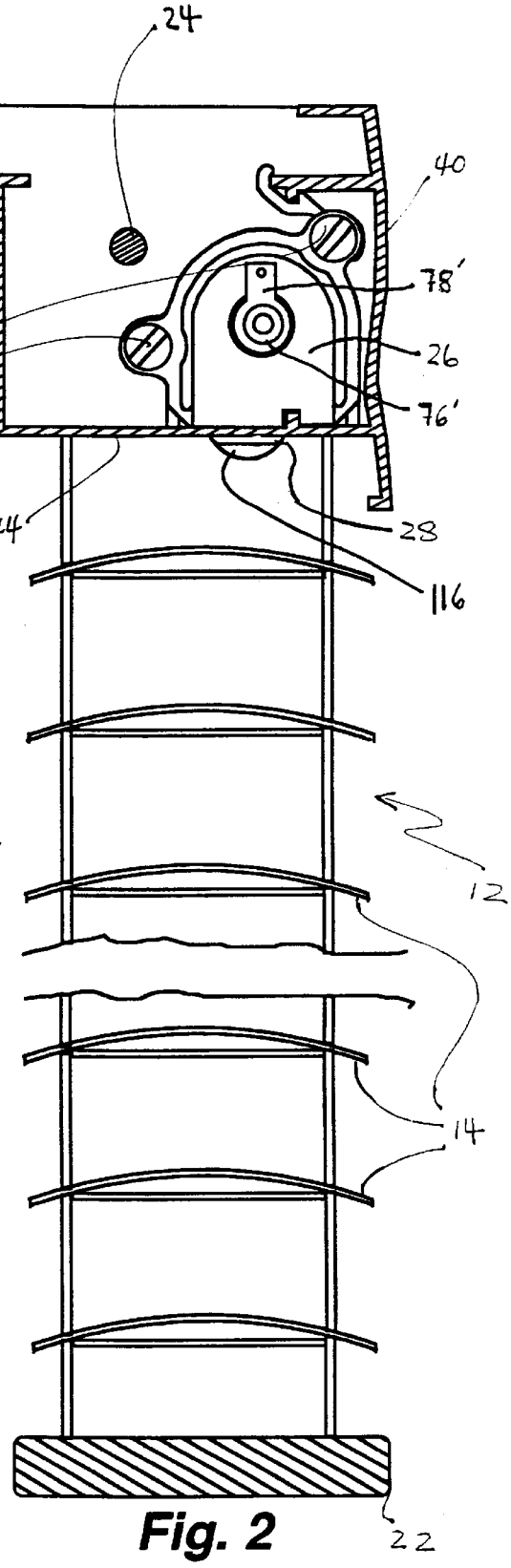
FIG. 2 is a fragmentary cross-sectional view taken along line 2—2 of FIG. 1, depicting the headrail including a battery magazine.

FIG. 2 is a fragmentary cross-sectional view along line 2—2 of FIG. 1. A tilt rod 24, which would be used to selectively adjust the configuration of the covering 12, is shown schematically in FIG. 2. Since FIG. 2 is a view looking inside of the headrail 10 with the left headrail end cap 18 removed, it is possible to see a first magazine end cap 26, which, as described more fully below, has a tab 28. This tab 28 snaps into a first tab slot 30 (FIGS. 4 and 5) to position and hold the battery magazine 32 (FIG. 4) within the headrail 10. Also depicted in FIG. 2 are two screws 34, which attach the first magazine end cap 26 to the magazine 32. A conductive terminal 78', which is connected to the first magazine end cap 26 by a fastener 76', is also clearly visible in FIG. 2. Further details concerning these features are described further below.

Figure 3:
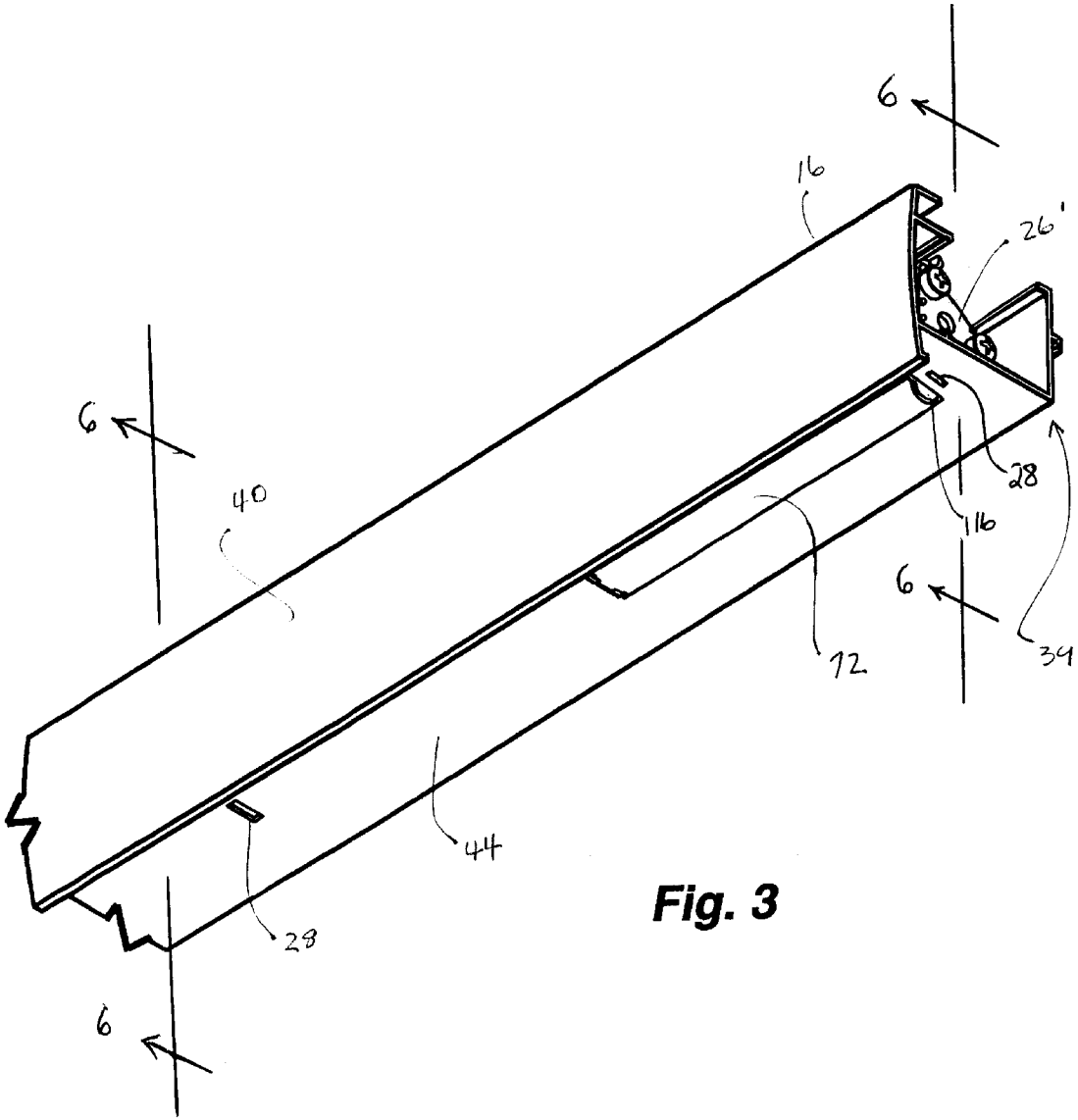
FIG. 3 is a fragmentary isometric view of the front, bottom, and right end of a housing and battery magazine used in the headrail of the present invention.
Figure 4:
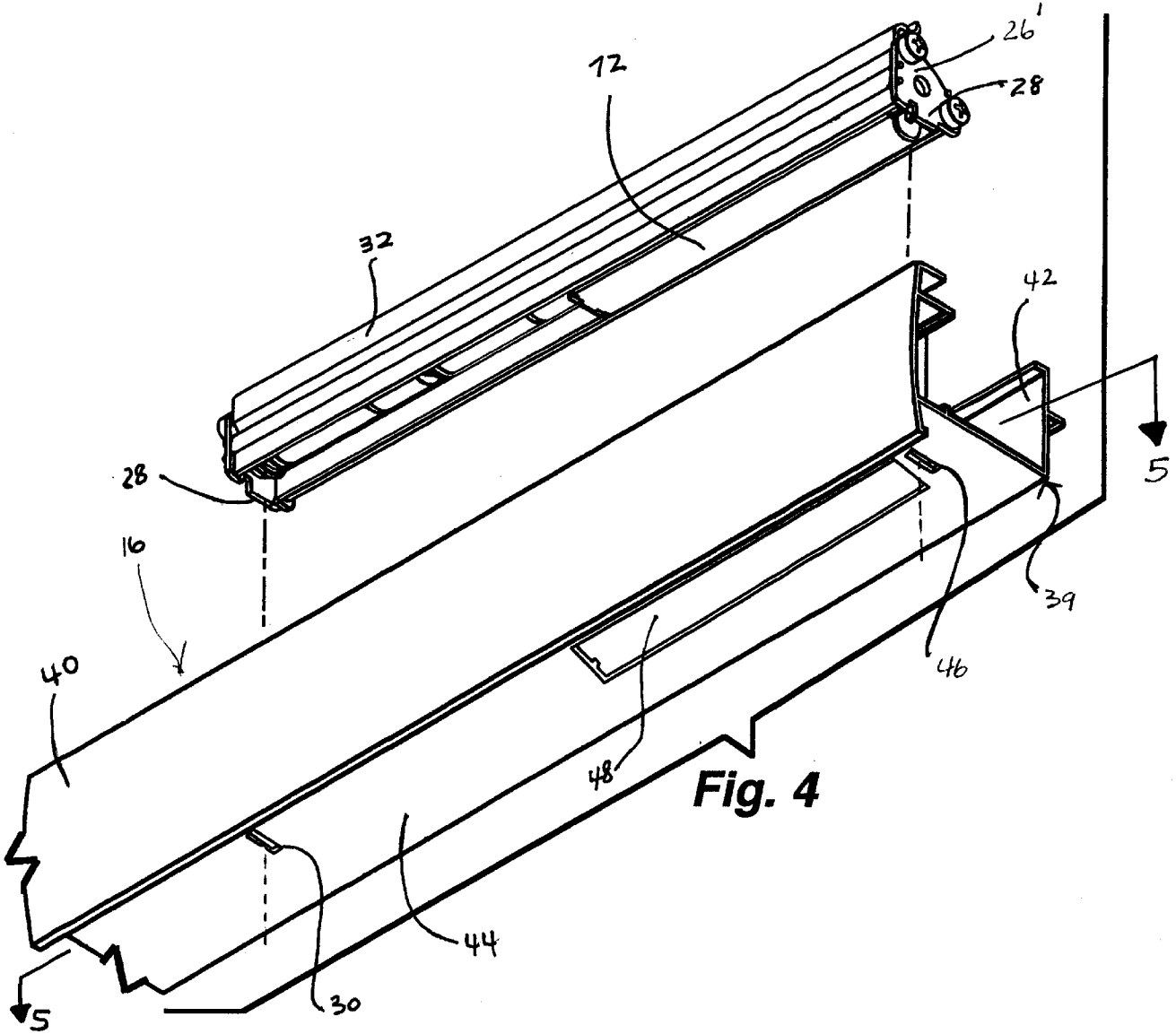
FIG. 4 is an exploded fragmentary isometric view of the headrail and magazine depicted in FIG. 3.
Figure 5:
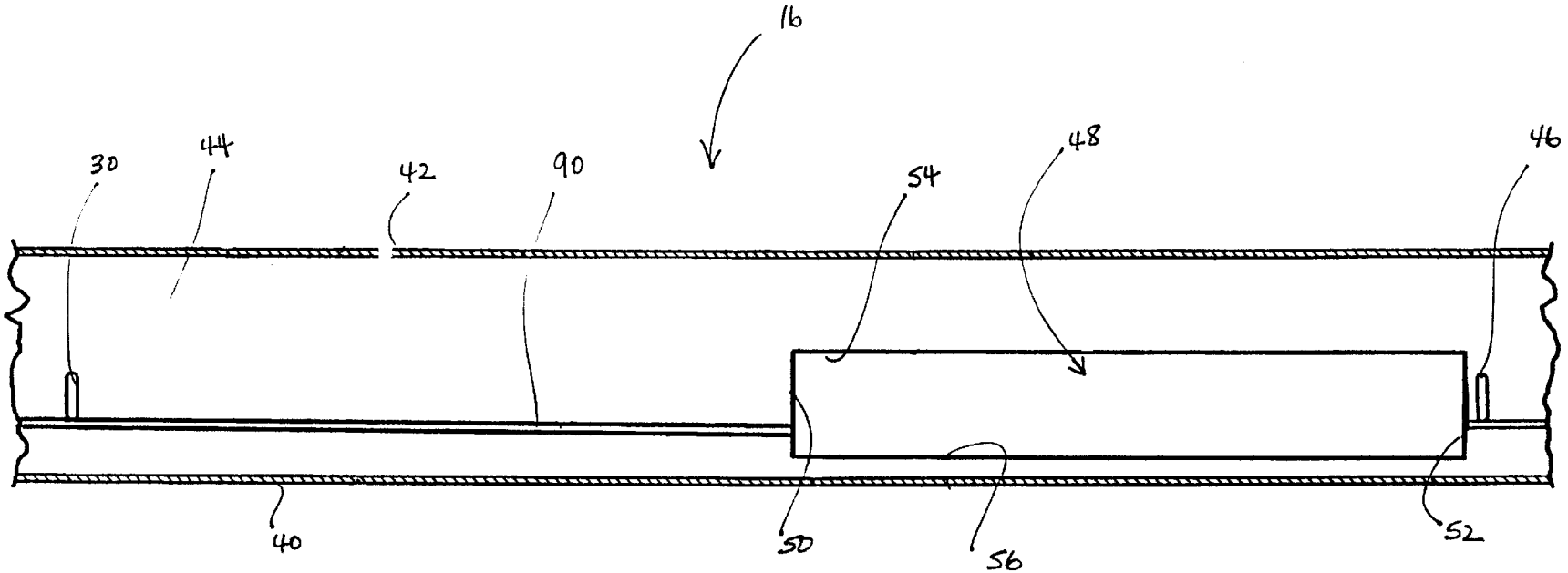
FIG. 5 is a fragmentary platform along line 5—5 of FIG. 4 of the bottom wall of the housing, including the opening therethrough.
Figure 12A:
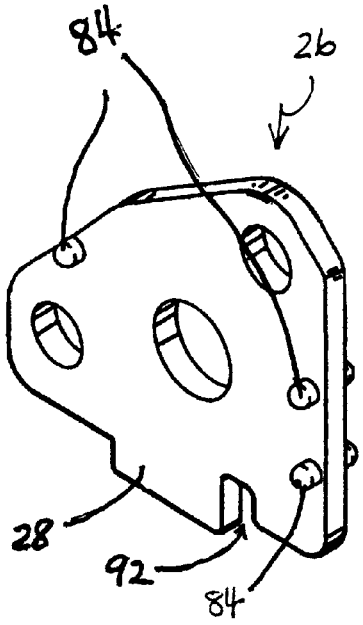
FIGS. 12A and 12B depict the two sides of a magazine end cap.
Figure 12B:
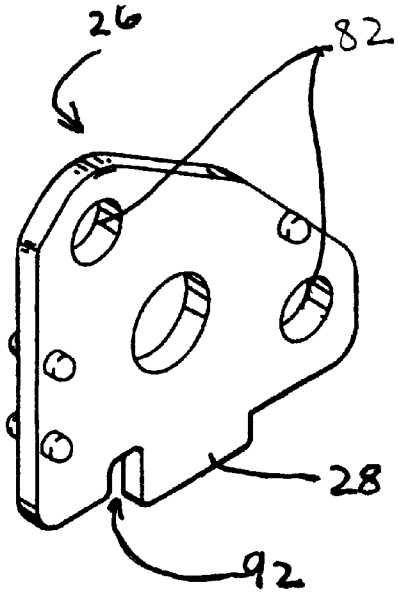

FIG. 3 is a fragmentary isometric view of the bottom, front, and right end of various components comprising part of the headrail 10. In particular, FIG. 3 depicts a fully assembled battery magazine (i.e., the battery magazine 32 having several other components attached thereto as described below) snapped into position within the headrail housing 16. The right end cap (not shown) has been removed from the right end 39 of the housing 16. FIG. 4 is similar to FIG. 3, but the fully assembled battery magazine is exploded from the housing 16. Referring to these two figures, it is clear that the housing 16 comprises a front wall 40, a rear wall 42, and a bottom wall 44 connecting the front wall 40 and rear wall 42. The design of the front wall 40 may vary widely depending upon the desired application. For example, the front wall 40 depicted in FIG. 2 is slightly different from the front wall 40 depicted in FIG. 7. The design of the rear wall 42 is generally less critical since the rear wall 42 is typically not visible when the headrail 10 is installed adjacent to an architectural opening. The important features of the housing 16 for purposes of the instant invention comprise the cutouts in the bottom wall 44. Referring most particularly to FIGS. 4 and 5, in the preferred embodiment, the bottom wall 44 includes a first tab slot 30, a second tab slot 46, and a relatively larger opening 48. The first and second tab slots 30, 46, respectively, accommodate the tabs 28 projecting from each magazine end cap 26. The tabs 28 are clearly visible in FIGS. 12A and 12B. The large opening 48 in the bottom wall 44 of the housing 16, includes a left edge 50, a right edge 52, a rear edge 54, and a front edge 56. Details concerning the several components attached to the magazine 32 are described more fully below in connection with FIG. 8.

Figure 6:
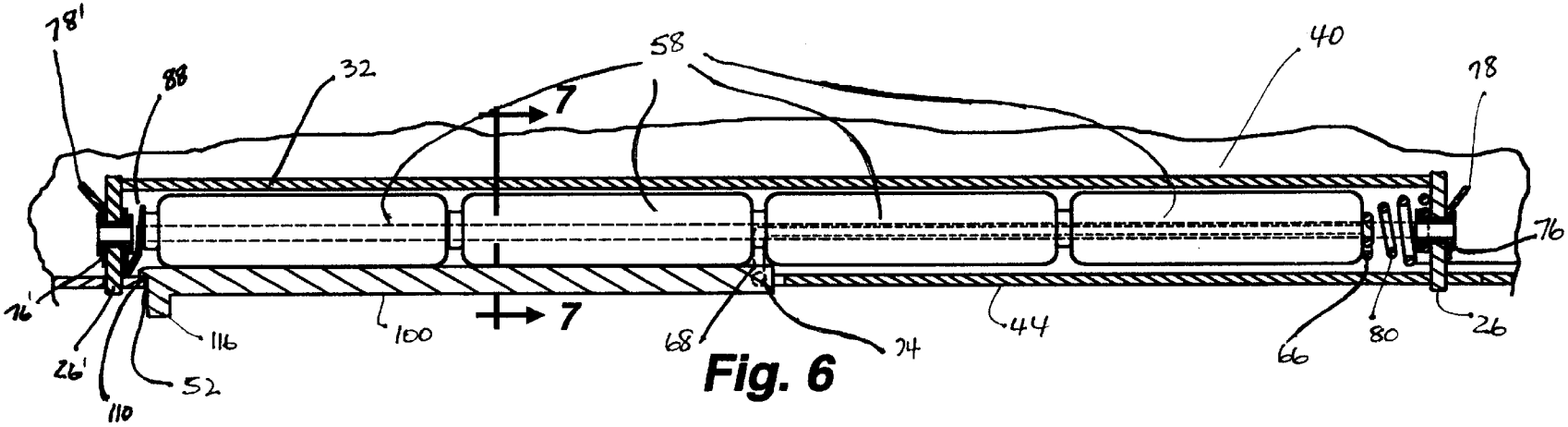
FIG. 6 is a fragmentary cross-sectional view taken along line 6—6 of FIG. 3, depicting the battery magazine mounted in the housing.
Figure 7:
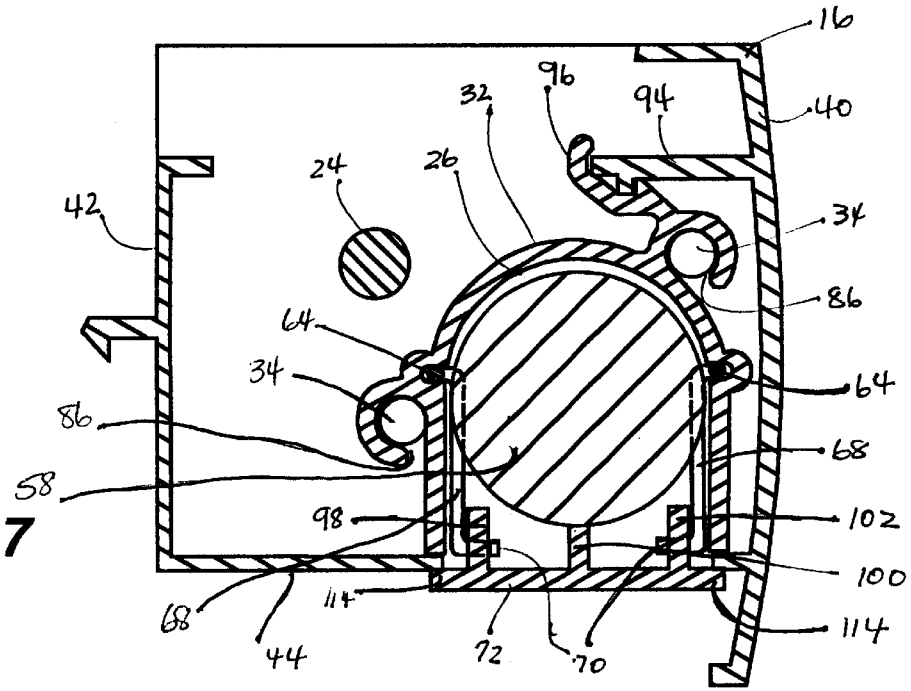
FIG. 7 is a cross-sectional view along line 7—7 of FIG. 6.
Figure 8:
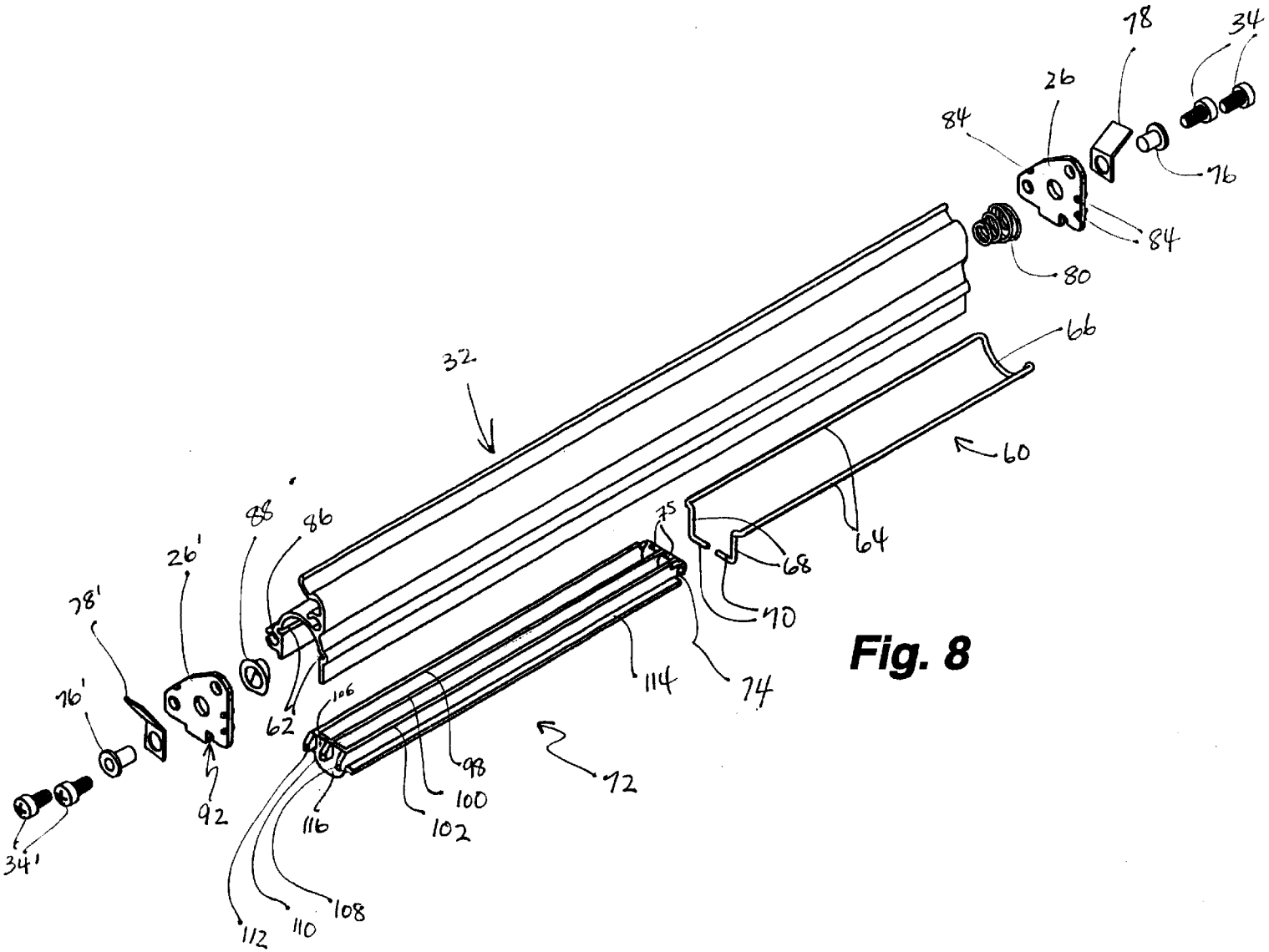
FIG. 8 is an exploded isometric view of the battery magazine and various components attached thereto.

FIG. 6 is a fragmentary cross-sectional view along line 6—6 of FIG. 3. This figure shows the magazine 32 containing batteries 58 snapped into position within the housing 16, the front wall 40 of which is partly visible in FIG. 6. FIG. 7 is a cross-sectional view along line 7—7 of FIG. 6. FIG. 8 is an exploded isometric view of the battery magazine 32 and all of the various components that are attached to it to make up the fully assembled battery magazine. Referring to FIGS. 6–8, the various components that are attached to the magazine 32 are described next.

The magazine 32 itself comprises a section of material having a cross-section that varies depending upon the selected configuration of the housing 16. FIG. 7 depicts the particular cross-sectional shape of the magazine 32 and housing 16 used in the preferred embodiment of the present invention. The particular cross-sectional shape of the magazine 32 and housing 16 are not critical to the present invention, and any one of the configurations depicted in the above-mentioned related application Ser. No. 09/481,237 could be used, among others.

Figure 9:
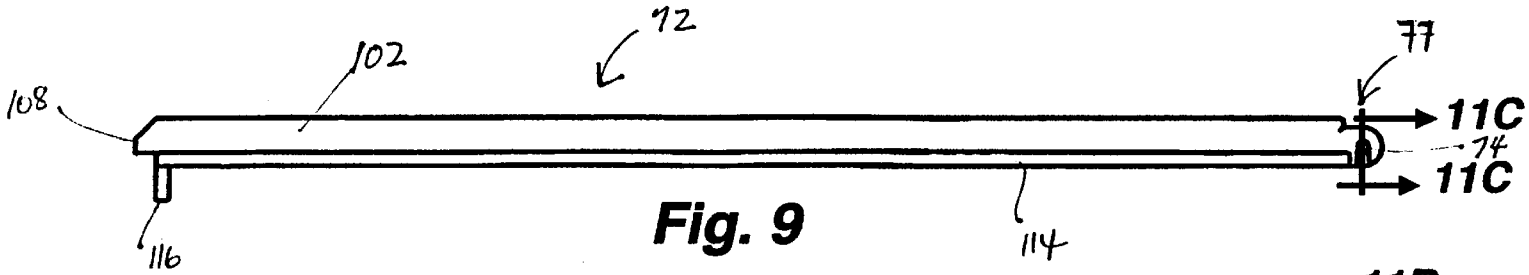
FIG. 9 is an elevation, showing the left side of a trap door according to a preferred embodiment of the present invention.
Figure 10:
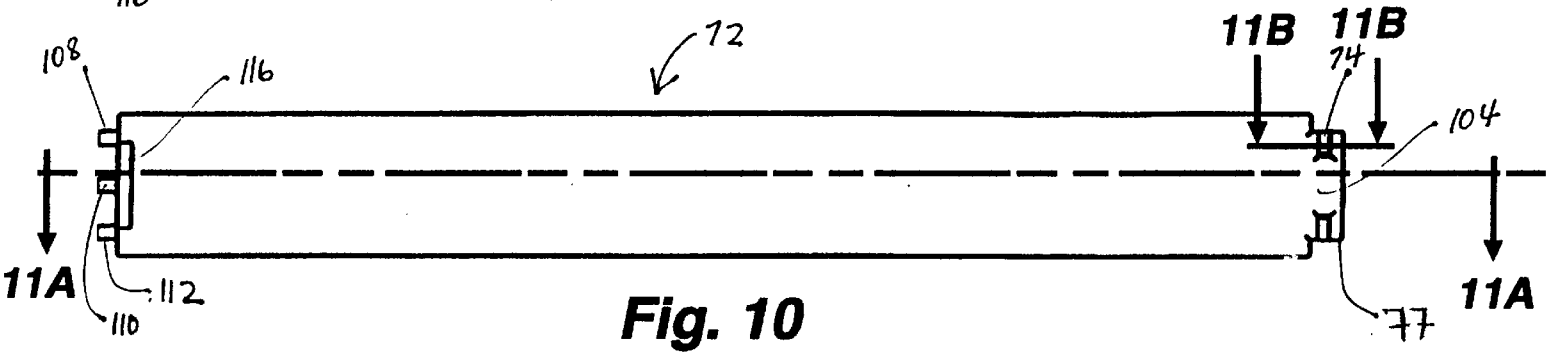
FIG. 10 is a view of the bottom surface of the trap door depicted in FIG. 9.

To assemble the magazine, a battery bracket 60 is slid into a pair of rail guide channels 62 integrally formed as part of the inner surface of the magazine 32. The battery bracket 60 comprises two substantially horizontal rails 64 that are spaced an appropriate distance (i.e., just greater than the diameter of a battery 58) from each other. These rails 64 easily slip into the rail guide channels 62. Two ends of the battery bracket rails 64 of the preferred embodiment are connected by an arcuate cross-over section 66. The opposite ends of the rails jog inwardly slightly (i.e., at least enough to get out of the rail guide channels 62) before turning downwardly to form risers 68. At the lowest ends of the risers 68, the battery bracket 60 is bent inwardly to form door catches or mounts 70. To connect the battery bracket 60 to the trap door 72, the battery bracket rails 64 are spread slightly until the door catches 70 can be inserted into a bracket-retention channel 74 forming part of an extended portion 77 (FIG. 9) of the trap door 72.

As shown in FIG. 7, the inside walls of the magazine 32 prevent the risers 68 from moving apart once the battery bracket 60 is installed in the magazine 32 (i.e., once the rails 64 are slid into the rail guide channels 62). Thus, once the battery bracket 60 is attached to the trap door 72 and the battery bracket 60 is slid into the rail guide channels 62, the door catches 70 swingably retain the trap door 72 on the bottom side of the magazine 32. As shown to best advantage in FIG. 6, the arcuate cross-over section 66 of the battery bracket 60 is shallow enough that it impinges upon an end of one of the batteries 58 installed in the magazine 32. Also, when the rails 64 jog inwardly before extending downwardly to form the risers 68, the distance that the rails 64 jog toward each other may be far enough that each of the risers 68 also impinges upon an opposite end of a different battery 58 during battery extraction. This configuration is shown by the dashed lines in the preferred embodiment of FIG. 7. In the alternative, however, the rails 64 may jog inwardly just enough to get out of the rail guide channels 62, but not so much that they impinge upon an end of a battery 58. In this case, the risers 68 would ride near the inner walls of the magazine 32 and not impact the end of a battery 58.

Once the battery bracket 60 and trap door 72 have been positioned on the magazine 32, the remaining components associated with the magazine 32 may be assembled. Referring to the right hand end of FIG. 8, a fastener 76 (e.g., a rivet) is used to connect a conductive terminal 78 to the outer surface of the first magazine end cap 26 while simultaneously attaching a spring 80 to an inside surface of the first magazine end cap 26. In this manner, electrical energy may be conducted from one terminal of the battery 58 through the spring 80 to the conductive terminal 78 when the battery 58 is installed in the assembled battery magazine depicted in FIG. 6. After the conductive terminal 78 and spring 80 have been connected to the first magazine end cap 26, the first magazine end cap 26 is attached to the magazine 32. The first magazine end cap 26 has a pair of attachment holes 82 (FIGS. 12A and 12B) through it and multiple alignment pins 84 associated with it. After the end cap 26 is properly aligned with an end of the magazine 32, with the alignment pins 84 riding adjacent to the inner surface of the magazine 32, the screws 34 are passed through the attachment holes 82 and are screwed into the screw channels 86 (FIG. 7) integrally formed as part of the magazine 32. Clearly, different types of magazine end caps could be used. For example, magazine end caps like those described and shown in the aforenoted related application Serial No. 09/481,231 would work. These alternative magazine end caps have attachment ears with attachment holes in them, and they have alignment ridges rather than alignment pins.

Referring now to the left end of FIGS. 6 and 8, assembly of the components attached to a second magazine end cap 26' is described next. In the preferred embodiment, the second magazine end cap 26' is interchangeable with the first magazine end cap 26. A fastener 76' is used to connect a conductive terminal 78' to the outer surface of the second magazine end cap 26' while simultaneously fastening a flexible conductor 88 to an inside surface of the second magazine end cap 26'. The assembled second magazine end cap 26' is best seen in FIG. 6. After the flexible conductor 88 and the conductive terminal 78' have been fastened to the second magazine end cap 26', the second magazine end cap 26' is attached to the magazine 32 using a pair of screws 34' in the same manner as the first magazine end cap 26 was attached to the opposite end of the magazine 32.

After the magazine has been assembled as just described, it is snapped into position in the housing 16 as shown in FIGS. 4 and 3. In this preferred embodiment, the assembled magazine is held in position in the housing by the tabs 28 integrally formed as part of the first and second magazine end caps 26, 26'. Also, a rib 90 (FIG. 5) integrally formed along the inner surface of the bottom wall 44 of the housing 16 in the preferred embodiment is captured by notches 92 (FIGS. 8, 12A, and 12B) formed in the bottom of each magazine end cap 26, 26'. Also, the magazine is held in position by the interaction between a portion 94 of the housing 16 that extends rearwardly from the front wall 40 of the housing 16 and a placement tang 96 comprising part of the magazine 32. This interaction between the portion 94 of the housing 16 and the placement tang 96 is shown to good advantage in FIG. 7 and is fully explained in the aforenoted related application Ser. No. 09/481,237.

Figure 11C:
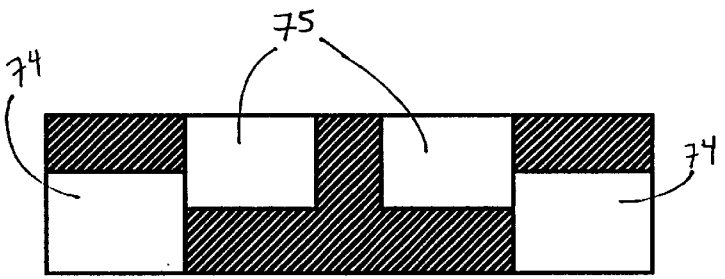
FIG. 11C is a cross-sectional view along line 11C—11C of FIG. 9.
Figure 11B:
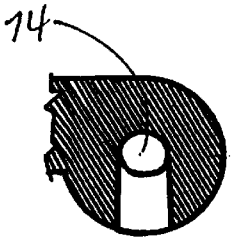
FIG. 11B is a fragmentary cross-sectional view along line 11B—11B of FIG. 10.
Figure 11A:
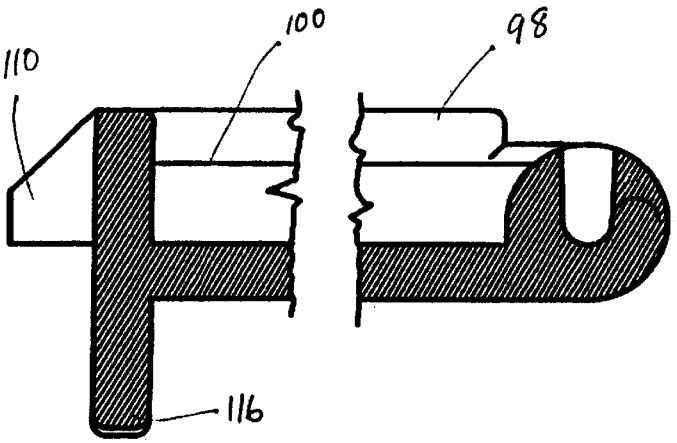
FIG. 11A is a fragmentary cross-sectional view along line 11A—11A of FIG. 10.

FIGS. 8, 9, 10, 11A, 11B, and 11C depict various views of the trap door 72 comprising part of the present invention. As shown to best advantage in FIG. 8, the upper or inside wall of the trap door 72 comprises a rear rib 98, a center rib 100, and a front rib 102. As best seen in FIG. 7, the center rib 100 is slightly shorter than the front rib 102 and the rear rib 98, thereby creating a cradle that supports the batteries 58 within the magazine 32. Each of the ribs 98, 100, 102 terminates at one end adjacent to the extended portion 77 of the trap door. As previously explained, the extended portion 77 comprises the bracket-retention channel 74. A covered portion 104 (FIG. 10) helps to retain the door catches 70 of the battery bracket 60 in the bracket-retention channel 74. The opposite ends of the three ribs 98, 100, 102 terminate at a wall 106 (FIG. 8) that is substantially perpendicular to the longitudinal axis of the trap door 72. A front protrusion 108, a center protrusion 110, and a rear protrusion 112 are formed on the opposite side of the wall 106 and correspond with the front rib 102, the center rib 100, and the rear rib 98, respectively. The trap door 72 further comprises a pair of protruding strips 114, one of which is visible in FIGS. 8 and 9, and both of which are visible in cross-section in FIG. 7. As shown to best advantage in FIG. 7, when the trap door 72 is in its closed position, the protruding strips 114 slightly overlap the bottom wall 44 of the housing 16 to thereby conceal the large opening 48. In contrast, the front and rear ribs 102, 98, respectively, are positioned closely enough to each other that they may pass through the large opening 48 in the bottom wall 44 of the housing 16. In particular, the front rib 102 passes inside of the front edge 56 (FIG. 5) of the large opening 48, and the rear rib 98 passes inside of the rear edge 54 of the large opening 48, when the trap door 72 is closed. FIGS. 11B and 11C clearly depict additional features. For example, FIG. 11C shows the pockets 75 on the upper surface of the extended portion 77 of the trap door 72. These pockets 75 are also visible on, for example, FIG. 8.

The trap door 72 is retained in its closed condition by the protrusions 108, 110, 112. As seen to good advantage in FIG. 6, which only depicts the center protrusion 110, when the trap door 72 is closed, the protrusions 108, 110, 112 snap past the right edge 52 of the large opening 48, and the undersides of the protrusions 108, 110, 112 rest on the inside of the bottom wall 44 of the housing 16. As most clearly visible in FIGS. 8, 9, and 11A, the upper surface of each protrusion 108, 110, 112 is sloped to facilitate snapping the trap door 72 closed. As the trap door 72 is forced closed, the sloped upper surfaces of the protrusions 108, 110, 112 impact on the outside of the bottom wall 44 of the housing 16, causing the trap door 72 and housing 16 to flex slightly until the protrusions 108, 110, 112 snap inside of the housing 16 to hold the trap door 72 closed. To open the trap door 72, a handle 116 (FIGS. 8–11A) is integrally formed on the bottom surface of the trap door 72. To open the trap door 72, downward force is applied to the handle 116 until the protrusions 108, 110, 112 snap past the bottom wall 44 of the housing 16, and the trap door 72 swings open on the door catches 70 comprising part of the battery bracket 60.

Figure 13:
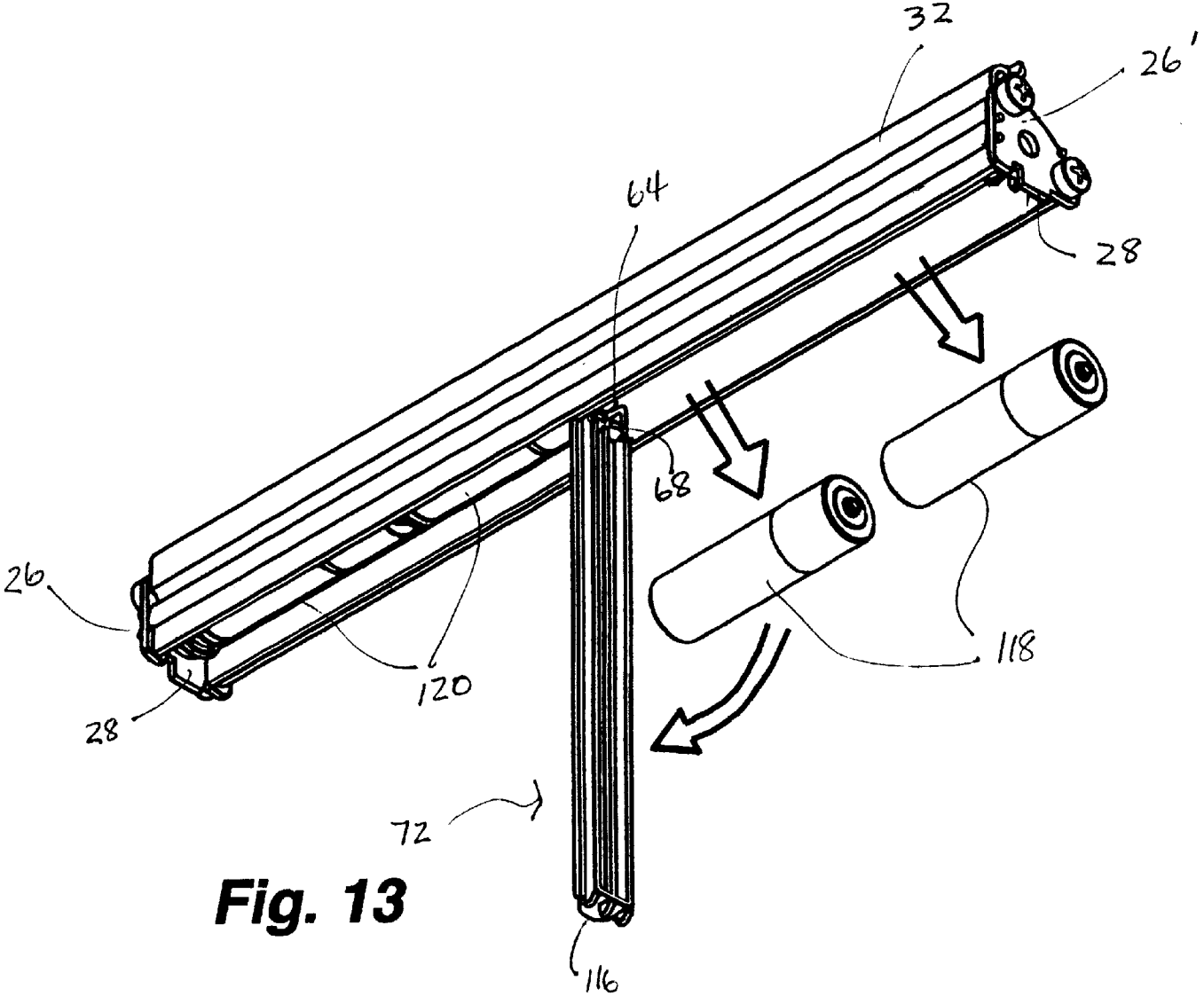
FIG. 13 is an isometric view of the assembled battery magazine in operation, but with the housing removed, depicting the removal of a first pair of batteries.
Figure 14:
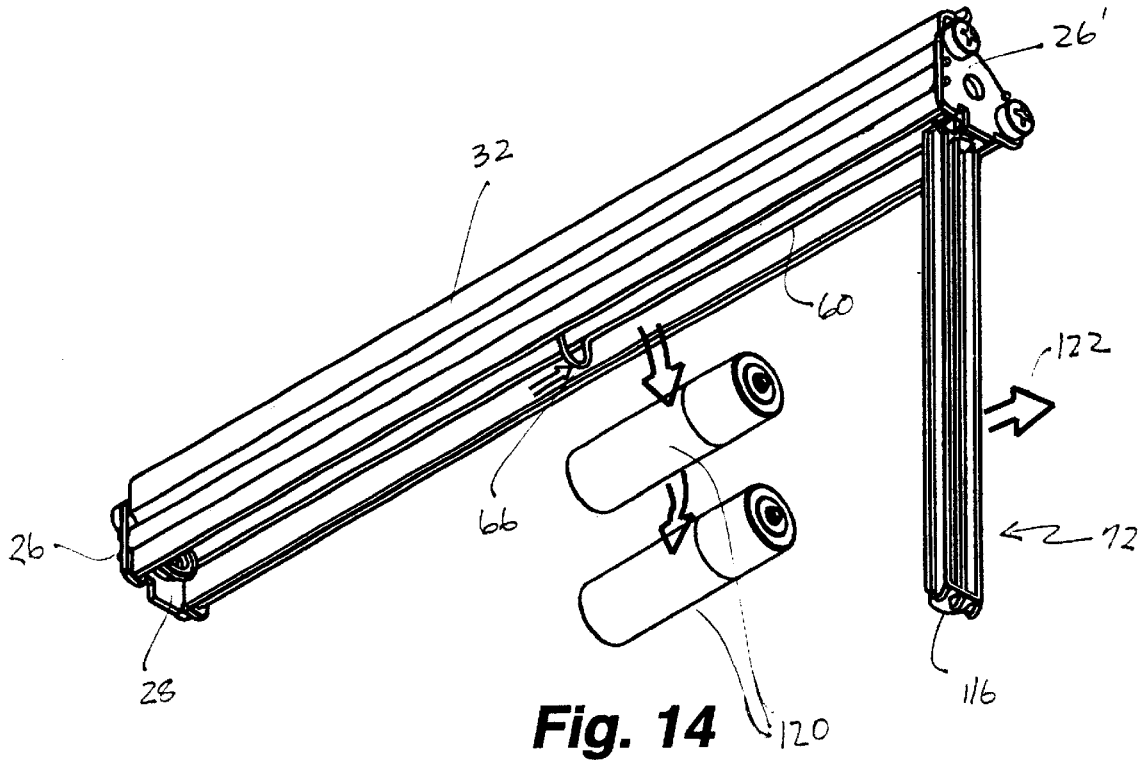
FIG. 14 is an isometric view similar to FIG. 13, but depicting the removal of a second pair of batteries.

Referring to FIGS. 13 and 14, operation of the trap door 72 is described. As depicted in these figures, four batteries 58 are mounted in the battery magazine 32. These batteries 58 comprise a first pair of batteries 118 and a second pair of batteries 120. The housing 16 has been removed to make it easier to see what is going on in these operational views. In FIG. 13, a downward force has been applied to the handle 116 of the trap door 72, and the trap door 72 has been swung open on the door catches 70. As the trap door 72 swings open, the first pair of batteries 118 drop from the battery magazine 32. Subsequently, the trap door 72 is slid rightward in the direction of arrow 122, which pulls the battery bracket 60 to the right in the rail guide channels 62 (FIG. 8). As the battery bracket 60 is pulled to the right, the arcuate cross-over section 66 of the battery bracket 60 pulls the second pair of batteries 120 rightward in the battery magazine 32. As shown in FIG. 6 and described above, the arcuate cross-over section 66 is shallow enough that it impinges upon an end of the batteries 58. As the second pair of batteries 120 reach the large opening 48 in the bottom wall 44 of the housing 16, they too would drop from the magazine 32 as shown in FIG. 14. To reinstall batteries, the steps just described would be reversed. Starting with FIG. 14, the second pair of batteries 120 would be inserted into the magazine 32. Then, the trap door 72 would be slid leftward opposite the direction of arrow 122, which would simultaneously slide the battery bracket 60 leftward and permit the second pair of batteries 120 to be installed in the magazine 32 above the bottom wall 44 of the housing 16. Then, with the second pair of batteries 120 in position in the magazine 32, and the trap door 72 in the position shown in FIG. 13, the first pair of batteries 118 could be inserted into the magazine 32 before the trap door 72 is swung upward and closed.

Although a preferred embodiment of this invention has been described above, those skilled in the art could make numerous alterations to the disclosed embodiment without departing from the spirit or scope of this invention. For example, numerous configurations for the magazine 32 and housing 16 could be used. Further, it is not important that the trap door 72 have precisely three protrusions 108, 110, 112, and the shape of the protrusions could be altered. For example, the protrusions 108, 110, 112 could comprise semi-circular bumps formed on the trap door 72. Also, any number of batteries 58 could be mounted depending upon the requirements of the device to which the batteries supply power. All directional references (e.g., upper, lower, upward, downward, left, right, leftward, rightward, top, bottom, above, below, vertical, horizontal) above are only used for identification purposes to aid the reader's understanding of the present invention, and do not create limitations, particularly as to the position, orientation, or use of the invention. It is intended that all matter contained in the above description or shown in the accompanying drawings shall be interpreted as illustrative and not limiting.

We claim:

1. A headrail for a powered covering for an architectural opening the headrail comprising a bottom wall and an interior, wherein an opening is present in said bottom wall;

a battery magazine removably attached within said interior of said headrail such that least a portion of said battery magazine is positioned above said opening; and a trap door pivotally and slidably associated with said bottom wall of said headrail to selectably cover said opening.

2. The headrail of claim 1, filler comprising a battery-powered actuator mounted within said headrail.

3. The headrail of claim 1 further comprising a battery bracket including at least one door mount, and wherein said trap door is swingably mounted on said at least one door mount.

4. The headrail of claim 3, wherein said trap door further comprises a first longitudinal end, a second longitudinal end, and a bracket-retention channel adjacent said first longitudinal end, and wherein said at least one door mount is pivotally connected to said trap door at said bracket-retention channel to swingably mount said trap door.

5. The headrail of claim 4, wherein said trap door further comprises at least one protrusion at said second longitudinal end, wherein said at least one protrusion holds said trap door closed after said trap door has been pivoted against said bottom wall of said headrail to selectively cover said opening.

6. The headrail of claim 5, wherein said trap door further comprises a handle adjacent said at least one protrusion.

7. A headrail for a powered covering for an architectural opening, comprising a housing including a bottom wall and an interior, and wherein an opening is present in said bottom wall;

a battery magazine including two rail guide channels and being attached within said interior of said housing such that a least a portion of said battery magazine is positioned above said opening in said bottom wall of said housing;

a battery bracket including two rails, each rail having a first end and a second end, an arcuate crossover section joining said first ends of said rails, a pair of risers, one riser extending substantially downwardly from each of said second ends of said rails, and a pair of door mounts, one door mount extending inwardly from a lower end of each of said pair of risers, and wherein each of said rails is slidably mounted in one of said rail guide channels; and a trap door comprising a first longitudinal end, a second longitudinal end, and a bracket-retention channel adjacent said first longitudinal end, wherein said door mounts engage said bracket-retention channel, thereby mounting said trap door adjacent said bottom wall of said housing to selectably cover said opening.

8. The headrail of claim 7, further comprising a battery-powered actuator mounted within said housing.

9. The headrail of claim 7, wherein said trap door is swingably mounted on said door mounts, and wherein said trap door further comprises at least one protrusion at said second longitudinal end, wherein said at least one protrusion holds said trap door closed after said trap door has been pivoted against said bottom wall of said housing to selectively cover said opening.

10. The headrail of claim 9, wherein said at least one protrusion includes a sloped surface that helps said at least one protrusion snap into said opening in said bottom wall of said housing.

11. The headrail of claim 9, wherein said at least one protrusion comprises a front protrusion, a center protrusion, and a rear protrusion.

12. The headrail of claim 11, wherein said trap door further comprises a handle adjacent said protrusions.

13. The headrail of claim 12, wherein said opening in said bottom wall of said housing comprises an edge over which said protrusions snap to selectably hold said trap door closed thereby holding batteries in said battery magazine.

14. The headrail of claim 12, wherein said opening in said bottom wall of said housing comprises two longitudinal edges and two lateral edges, and wherein said protrusions snap over one of said lateral edges to selectably hold said trap door closed thereby holding batteries in said battery magazine.

15. The headrail of claim 14, wherein said trap door further comprises longitudinal edges and a protruding strip along each of said longitudinal edges, wherein said protruding strips rest against an exterior of said bottom wall of said housing adjacent said longitudinal edges of said opening in said bottom wall when said trap door is closed, thereby hiding said longitudinal edges of said opening.

16. The headrail of claim 7, wherein said battery magazine is removably attached within said interior of said housing.

17. A headrail for a powered covering for an architectural opening, comprising a housing including a bottom wall and an interior, and wherein an opening is present in said bottom wall;

a battery magazine attached within said interior of said housing such that at least a portion of said battery magazine is positioned above said opening;

a trap door associated with said bottom wall of said housing to selectably cover said opening;

a battery-powered actuator mounted within said housing; and a battery bracket including at least one door mount, and wherein said trap door is swingably mounted on said at least one door mount, and wherein said battery bracket further includes at least one rail slidably connected to at least one of said battery magazine and said housing.

18. The headrail of claim 17 wherein said at least one rail comprises two rails, wherein said battery magazine comprises two corresponding rail guide channels, and wherein each of said rails is slidably mounted in one of said rail guide channels.

19. The headrail of claim 18 wherein said two rails of said battery bracket each has a first end and a second end, and wherein said first ends of said two rails are joined by a crossover section.

20. The headrail of claim 19 wherein said crossover section is arcuate.

21. The headrail of claim 15 wherein said second ends of said two rails jog inwardly toward one another and then extend substantially downwardly, forming a pair of risers, before jogging inwardly further, forming a pair of door mounts.

22. The headrail of claim 21 wherein said trap door further comprises a bracket-retention channel, and wherein each door mount of said pair of door mounts engages said bracket-retention channel thereby swingably mounting said trap door.

23. A headrail for a powered covering for an architectural opening, the headrail comprising a bottom wall and an interior, wherein an opening is present through said bottom wall;

a battery magazine attached within said interior of said headrail such that at least a portion of said battery magazine is positioned above said opening; and a trap door pivotally and slidably associated with said bottom wall of said headrail to selectably cover said opening, wherein said trap door comprises an inside wall having a rear longitudinal rib, a center longitudinal rib, and a front longitudinal rib.

24. The headrail of claim 23, wherein said center rib is slightly shorter than said front rib and said rear rib.

25. The headrail of claim 23, wherein said trap door further comprises an extended portion, and wherein each of said center rib, said front rib, and said rear rib terminates at one end adjacent to said extended portion of said trap door.

26. The headrail of claim 25 further comprising a battery bracket comprising a first door mount and a second door mount, and wherein said extended portion comprises a bracket-retention channel having a first end and a second end, and further wherein said first door mount engages said first end of said bracket-retention channel and said second door mount engages said second end of said bracket-retention channel to swingably mount said trap door.

27. The headrail of claim 23, wherein said trap door further comprises longitudinal edges and a protruding strip along each of said longitudinal edges, wherein said protruding strips rest against an exterior of said bottom wall of said headrail adjacent to longitudinal edges of said opening in said bottom wall when said trap door is closed, there by hiding said longitudinal edges of said opening.

28. The headrail of claim 23, wherein said front and rear ribs are positioned closely enough to each other to pass through said opening in said bottom wall of said headrail.

29. The headrail of claim 23, wherein first and second tab slots are present in said bottom wall of said housing, wherein said battery magazine further comprises first and second magazine end caps, said first end cap having a first tab projecting therefrom, and said second end cap having a second tabs projecting therefrom, and wherein said first tab slot accommodates said first tab and said second tab slot accommodates said second tab.

30. A headrail for a powered covering for an architectural opening, comprising a housing including a bottom wall and an interior, and wherein an opening is present in said bottom wall;

a battery magazine attached within said interior of said housing such that at least a portion of said battery magazine is positioned above said opening; and a trap door associated with said bottom wall of said housing to selectably cover said opening, wherein said trap door comprises an inside wall having a rear rib, a center rib, and a front rib, wherein first and second tab slots are present in said bottom wall of said housing, wherein said battery magazine further comprises first and second magazine end caps, said first end cap having a first tab projecting therefrom, and said second end cap having a second tab projecting therefrom, and wherein said first tab slot accommodates said first tab and said second tab slot accommodates said second tab.

31. The headrail of claim 30, wherein said housing further comprises a rib formed along an inner surface of said bottom wall, and wherein each of said first and second magazine end caps has a bottom having a notch formed therein, and wherein said notches accommodate said rib formed along said inner surface of said bottom wall.

32. The headrail of claim 30, wherein said housing further comprises a rearwardly extending portion, wherein said battery magazine further comprises a placement tang, and wherein said rearwardly extending portion interacts with said placement tang to attached said battery magazine within said interior of said housing.

33. The headrail of claim 26, wherein said battery bracket further comprises at least one rail slidably connected to said battery magazine.

34. The headrail of claim 33, wherein said at least one rail comprises two rails, wherein said battery magazine comprises two corresponding rail guide channels, and wherein each of said rails is slidably mounted in one of said rail guide channels.

35. A headrail for a powered covering for an architectural opening, the headrail comprising a bottom wall and an interior, wherein an opening exists through said bottom wall, a battery magazine removably attached within said interior of said headrail such that at least a portion of said battery magazine is positioned above said opening; and a trap door pivotally and slidably mounted adjacent to said opening through said bottom wall to selectably cover said opening, said trap door comprising a first longitudinal end and a second longitudinal end, said first longitudinal end of said trap door being pivotally mounted to at least one of said battery magazine and said bottom wall.

36. The headrail of claim 35, wherein said battery magazine further comprises two rail guide channels, wherein said headrail further comprises a battery bracket comprising two rails, wherein each of said battery bracket rails is slidably mounted in one of said rail guide channels, and wherein said first longitudinal end of said trap door is pivotally mounted to at least one of said battery bracket rails.

* * * * *